United States Patent [19]

Matsko et al.

[11] 4,181,906

[45] Jan. 1, 1980

[54] CIRCUIT INTERRUPTER WITH INTERLOCKED REMOVABLE TRIP UNIT

[75] Inventors: Joseph J. Matsko, Beaver; Emroy W. Lange, Brighton Township, Beaver County; Paul Skalka, Beaver, all of Pa.

[73] Assignee: Westinghouse Electric Corp., Pittsburgh, Pa.

[21] Appl. No.: 853,983

[22] Filed: Nov. 23, 1977

[51] Int. Cl.[2] ..... H01H 75/02; H01H 77/02

[52] U.S. Cl. ..... 335/6; 335/132; 361/115

[58] Field of Search ..... 335/160, 172, 132; 361/96, 100, 115

[56] References Cited

U.S. PATENT DOCUMENTS

| | | | |
|---|---|---|---|
| 3,526,861 | 9/1970 | Walker et al. | 335/35 |
| 3,761,777 | 9/1973 | Willard et al. | 361/115 |
| 3,806,847 | 4/1974 | Salvati | 335/176 |
| 3,821,607 | 6/1974 | Matsko et al. | 361/115 |
| 4,037,184 | 7/1977 | Kempisty et al. | 335/160 |

*Primary Examiner*—Harold Broome

*Attorney, Agent, or Firm*—Robert E. Converse, Jr.

[57] ABSTRACT

A circuit interrupter is provided with a trip unit removably inserted into the housing of circuit interrupter through the cover thereof. The trip unit is secured to the housing by spring clips mounted therein cooperating with recesses in the enclosure of the trip unit to permit insertion of the trip unit with the cover installed but preventing removal of the trip unit without prior removal of the circuit interrupter cover.

8 Claims, 8 Drawing Figures

CIRCUIT INTERRUPTER WITH INTERLOCKED REMOVABLE TRIP UNIT

CROSS-REFERENCES TO RELATED APPLICATIONS

The present invention is related to material disclosed in co-pending U.S. Patent Application Ser. No. 853,940, entitled "Circuit Interrupter With Interchangeable Rating Adjuster And Interlock Means", filed Nov. 23, 1977, by A. E. Maier et al; U.S. Patent Application Ser. No. 853,991, entitled "Circuit Interrupter With Improved Adjustable Trip Unit", filed Nov. 23, 1977, by J. J. Matsko et al; U.S. Patent Application Ser. No. 853,990, entitled "Circuit Interrupter Having Interlocked Interchangeable Trip Unit", filed Nov. 23, 1977, by A. E. Maier et al; U.S. Patent Application Ser. No. 811,227, entitled "Trip Mechanism Reset", filed June 29, 1977, by S. A. Mrenna et al; and U.S. Patent Application Ser. No. 728,088, entitled "Circuit Breaker Apparatus Including Asymmetrical Fault Detector", filed Sept. 30, 1976, by A. B. Shimp et al.

BACKGROUND OF THE INVENTION

1. Field of the Invention:

The invention relates generally to electrical apparatus and more particularly to circuit interrupters having removable trip units.

2. Description of the Prior Art:

Circuit breakers are widely used to provide protection for electrical distribution circuits and apparatus. Increasing complexity of electrical distribution circuits has dictated the need for circuit breakers having capabilities more sophisticated then mere overcurrent trip functions, such as adjustable trip current ratings, ground fault circuit detection, and a variety of time delay capabilities. Such functions can be provided in an economical manner through the use of electronic circuitry contained in a trip unit of the circuit breaker. Further flexibility is obtained through the use of a removable interchangeable trip unit and rating adjuster.

The basic circuit breaker mechanism exhibits characteristics such as maximum continuous current rating and peak interruption current. Correspondingly, trip units and rating adjusters control such parameters as ground fault detection capability, maximum trip current level, time delay, and time-current characteristics. It is important that the characteristics of the trip units and rating adjusters be compatible with the characteristics of the circuit breaker into which they are inserted. A means of insuring this compatibility is described in the aforementioned U.S. Patent Application Ser. No. 853,990.

In addition, the interchangeability of trip units has raised the possibility that a circuit interrupter may be connected in its proper position in series in a circuit being protected, and yet, due to the removal of the trip unit, be incapable of performing its intended function should dangerous conditions arise upon the circuit. It is therefore desirable to provide a circuit interrupter having a removable trip unit which is interlocked with the contacts of the circuit interrupter to insure that such contacts will be open unless a trip unit is properly installed in the circuit interrupter.

SUMMARY OF THE INVENTION

In accordance with the principals of the present invention, there is provided a circuit interrupter comprising a housing including a removable cover. A circuit breaker mechanism is disposed in the housing and comprises separable contacts operable between open and closed positions. A trip mechanism is provided which is releasable to effect automatic opening of the contacts.

Also disposed in the housing of the circuit breaker is means for sensing current flow thrugh the contacts. The sensing means is connected to a removable trip unit which is disposed in the housing and is also connected to the trip mechanism. The trip unit causes a release of the trip mechanism upon overcurrent conditions through the contacts. Mounting means are provided for securing the trip unit to the housing, the mounting means permitting the trip unit to be inserted into the housing with the cover in place. However, the mounting means are disposed within the housing so as to be inaccessible without removal of the cover, thereby preventing removal of the trip without first removing the cover.

DESCRIPTION OF THE PREFERRED EMBODIMENT

Figure 1:
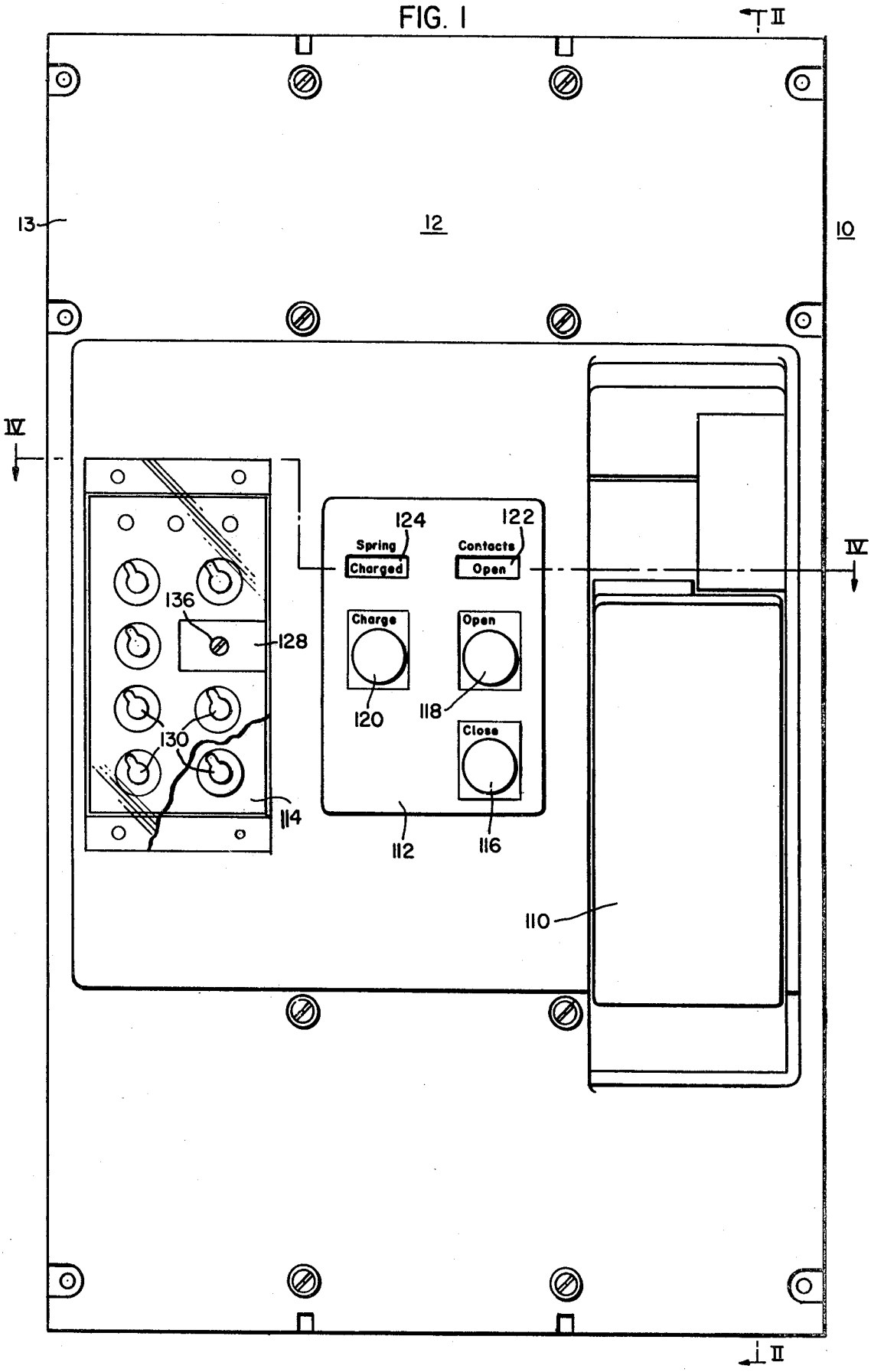
FIG. 1 is a front-elevational view of a circuit interrupter employing the principles of the present invention.
Figure 2:
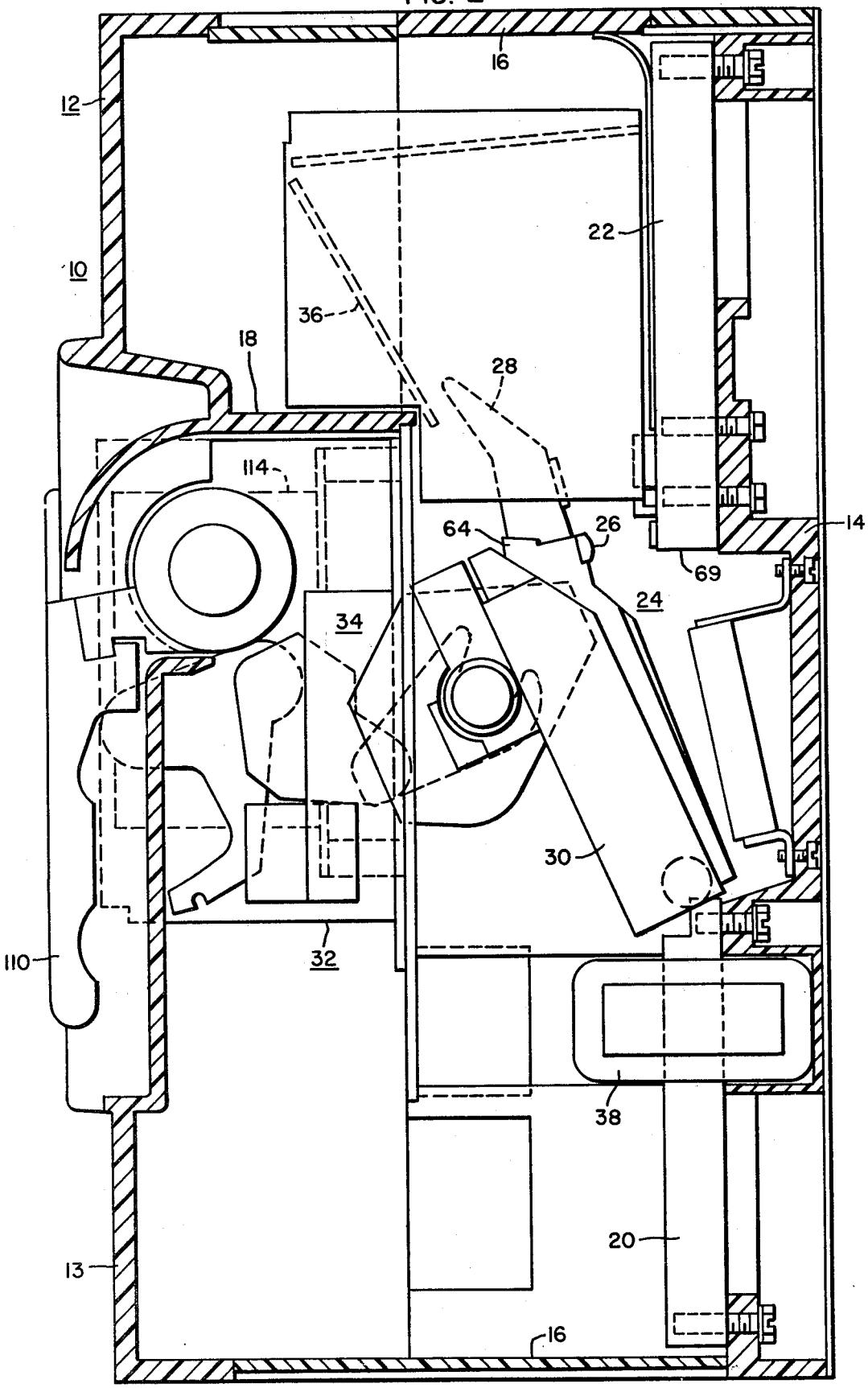
FIG. 2 is a side-elevational view of the circuit breaker of FIG. 1, taken along the line II—II of FIG. 1.

Referring now to the drawings, in which like reference characters refer to corresponding members, there is shown in FIGS. 1 and 2 a stored energy molded case circuit breaker 10 constructed in accordance with the principles of the present invention. Although the description of the invention is made with reference to this particular circuit breaker, it is to be understood that the invention is applicable to circuit breakers generally. The circuit breaker 10 includes a housing 12 comprising a cover 13, a mounting base 14, side walls 16, and a frame structure 18. A pair of stationary contacts 20, 22 are disposed within the housing 12. Stationary contact 22 would, for example, be connected to an incoming power line (not shown), while the other stationary contact 20 would be connected to the load (not shown). Electrically connecting the two stationary contacts 20, 22 is a movable contact structure 24. Movable contact structure 24 comprises a movable contact 26, a movable arcing contact 28, a contact carrier 30, and a contact holder 64. The movable contact 26 and the arcing contact 28 are pivotally secured to the stationary contact 20, and are operable between open and closed positions with respect to the stationary contact 22. Throughout this specification, the term "open" as used with respect to the contact positions means that the movable contacts 26, 28 are spaced apart from the stationary contact 22, whereas the term "closed" indicates the position wherein the movable contacts 26, 28 are contacting both stationary contacts 22 and 20. The movable contacts 26, 28 are mounted to and carried by the contact carrier 30 and contact holder 64.

Also included within the circuit breaker 10 is an operating mechanism 32, a toggle means 34, and an arc chute 36 which extinguishes any arc which may be present when the movable contacts 26, 28 are operated from the closed to the open position. A current transformer 38 is utilized to monitor the amount of current flowing through the stationary contact 20.

FIG. 1 shows the front of the cover 13 and the relative positions of an operating handle 110, a control panel 112, and a trip unit 114. The handle 110 is used for manual operation to charge powerful operating springs (not shown) providing stored energy to move the contacts 26, 28 between open and closed positions. This movement is controlled from the control panel 112 which includes push buttons 116, 118, 120 and indicating flags 122 and 124. The button 120 is used to activate a motor (not shown) which can perform the same operation as the handle 110 to charge the operating springs. When the springs are so charged, this status is indicated by the flag 124. Manual operation of the push button 116 or 118 will serve to discharge the operating springs and move the contacts 26, 28 between the open and closed positions. Such operation thus provides a switching function during periods of normal conditions.

During overload current conditions on the circuit, the contacts 26, 28 will move automatically from the closed to the open position. The characteristics of this tripping operation are controlled by the trip unit 114 which contains electronic circuitry to process the sensing signals produced by the transformer 38. This circuitry is described more completely in the aforementioned U.S. Patent Application Ser. No. 728,088. The nominal level of current which will initiate the tripping operation, i.e., the trip current rating, is determined by a removable plug-in rating adjuster 128 which contains resistance means cooperating with the electronic circuitry within the trip unit 114 to establish the trip current rating. Other characteristics of the trip unit are adjustable through the use of controls 130, more completely described in the aforementioned copending U.S. Patent Application Ser. No. 853,911.

Figure 3A:
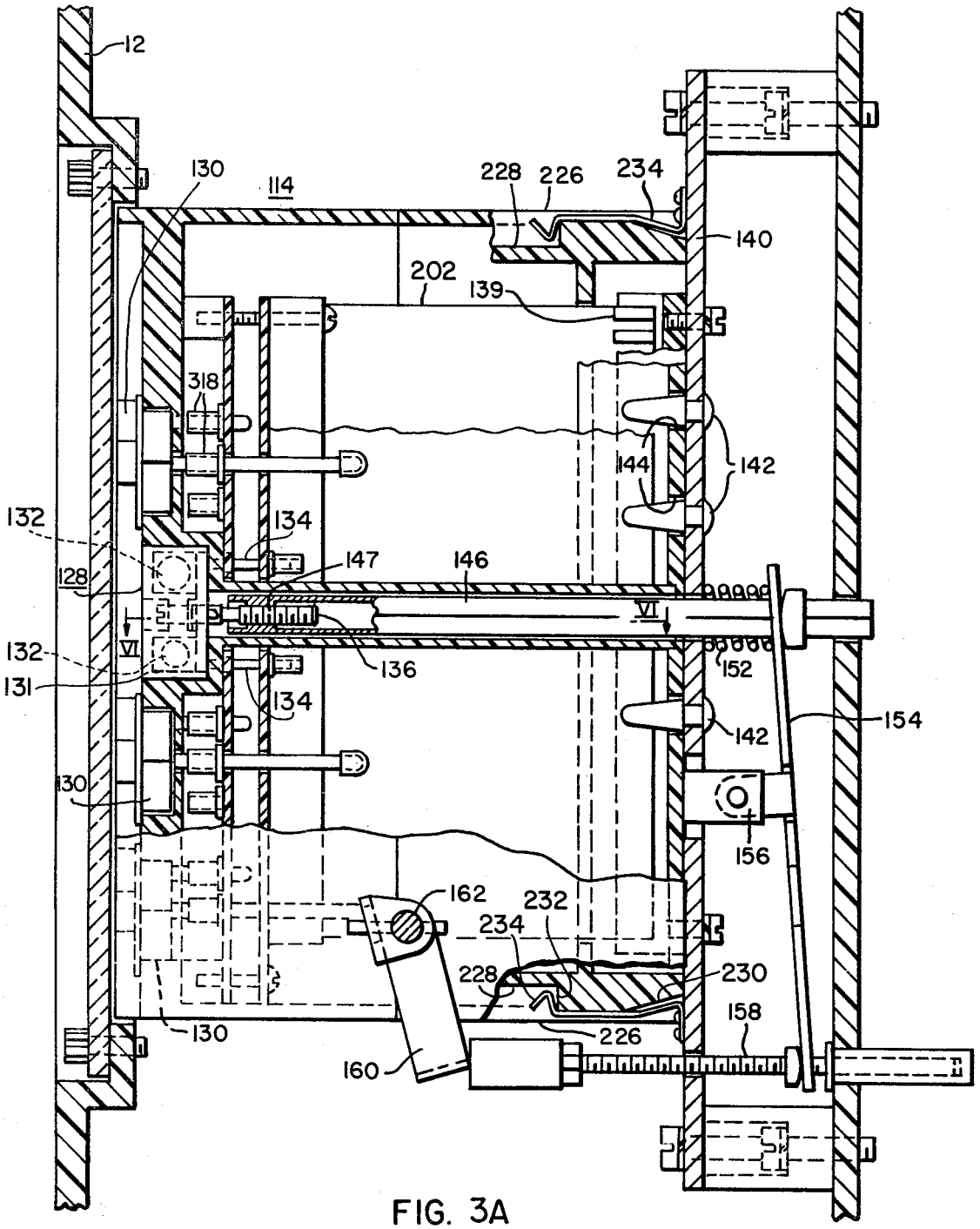
FIG. 3A is a detailed side-sectional view of the trip unit portion of the circuit interrupter shown in FIGS. 1 and 2.
Figure 3B:
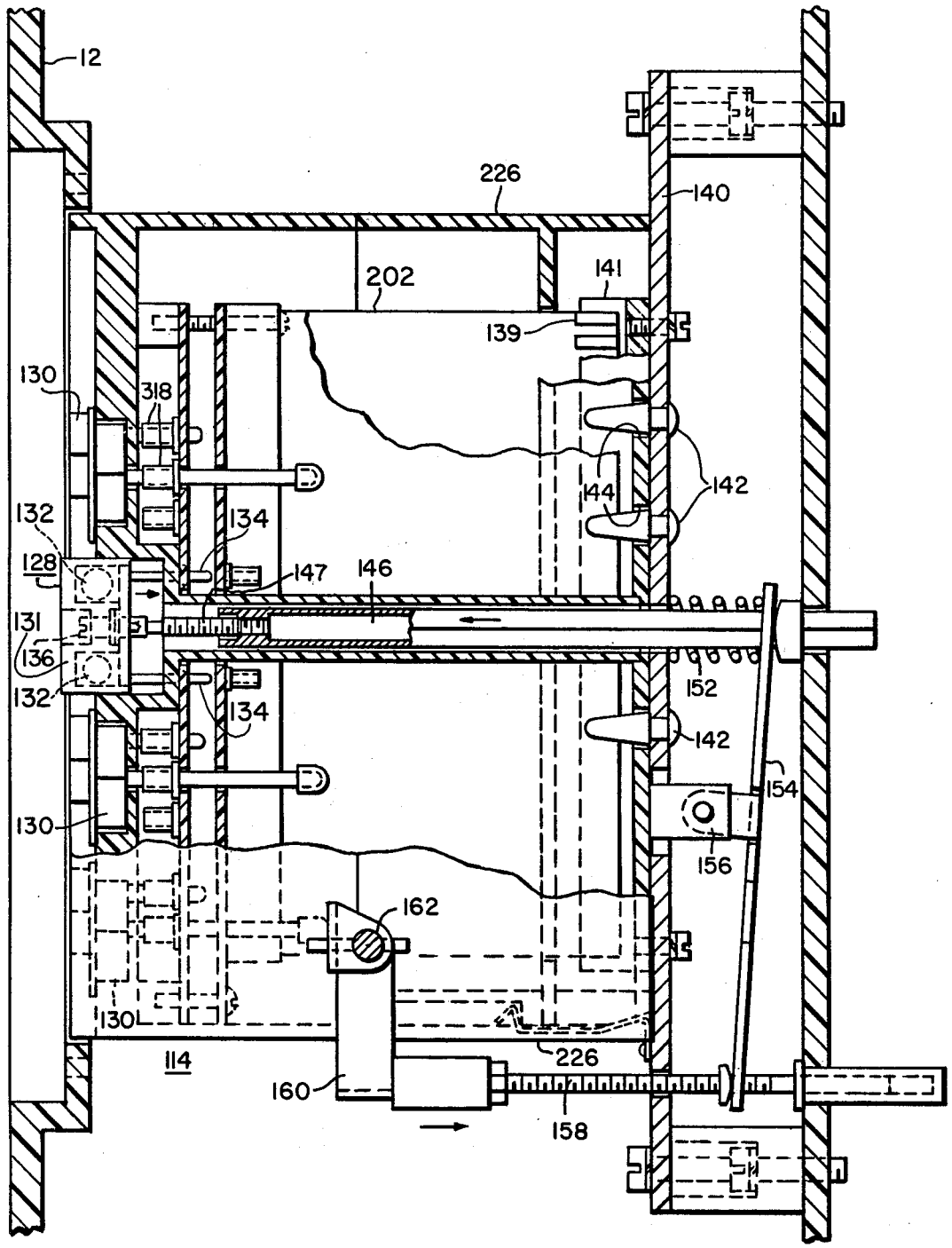
FIG. 3B is a view similar to FIG. 3A, with the rating adjuster only partially inserted.

The construction of the rating plug 128 is seen most clearly in FIGS. 3A and 3B. A housing 131 of molded insulating material contains a pair of resistors 132 supported upon plug-in connecting pins 134. A threaded rod or screw 136 extends through the housing 131 and is movably secured by captivation in rating plug base and cover.

Figure 4:
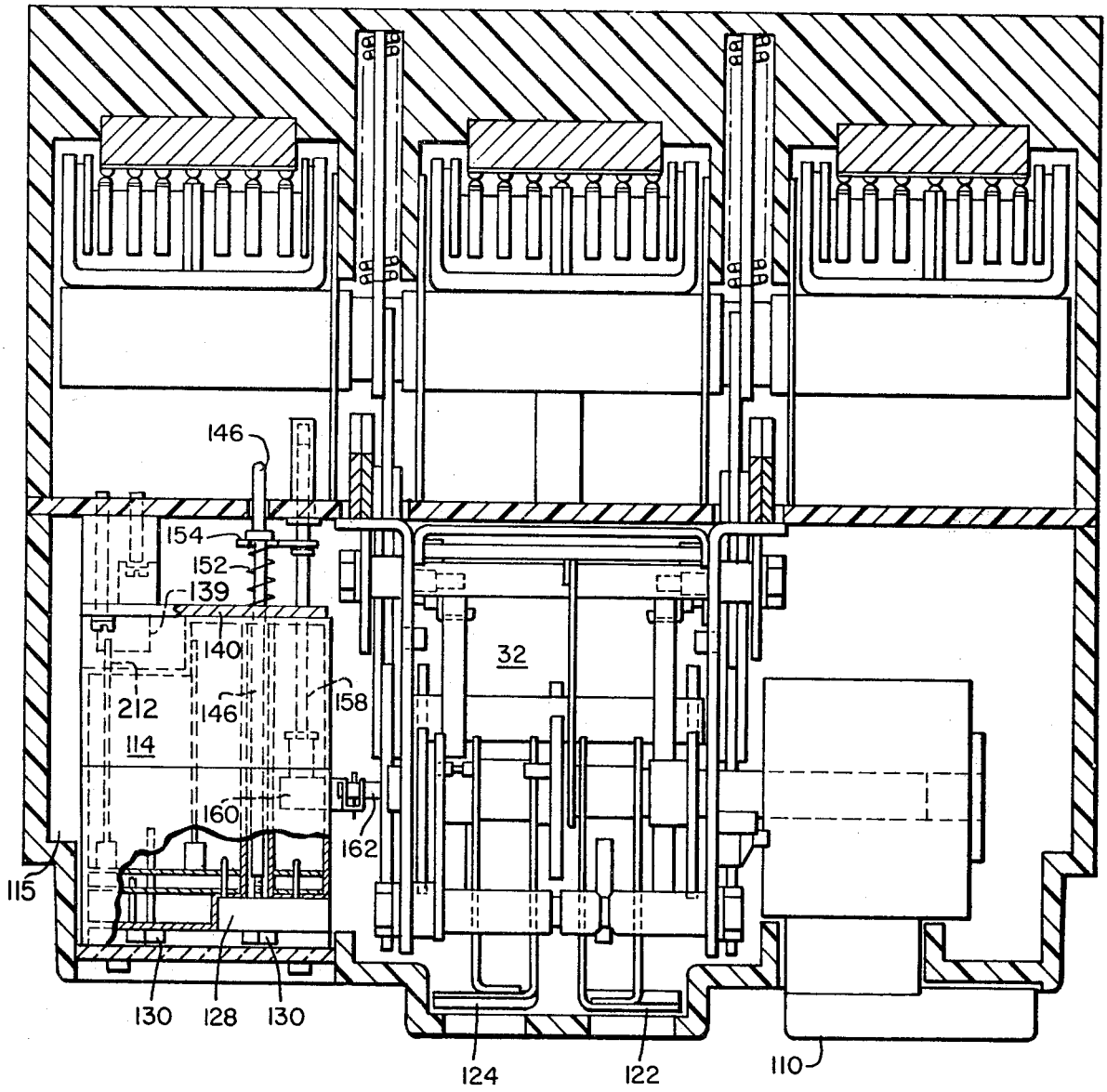
FIG. 4 is a sectional view of the circuit interrupter taken substantially along the line IV—IV of FIG. 1.
Figure 5:
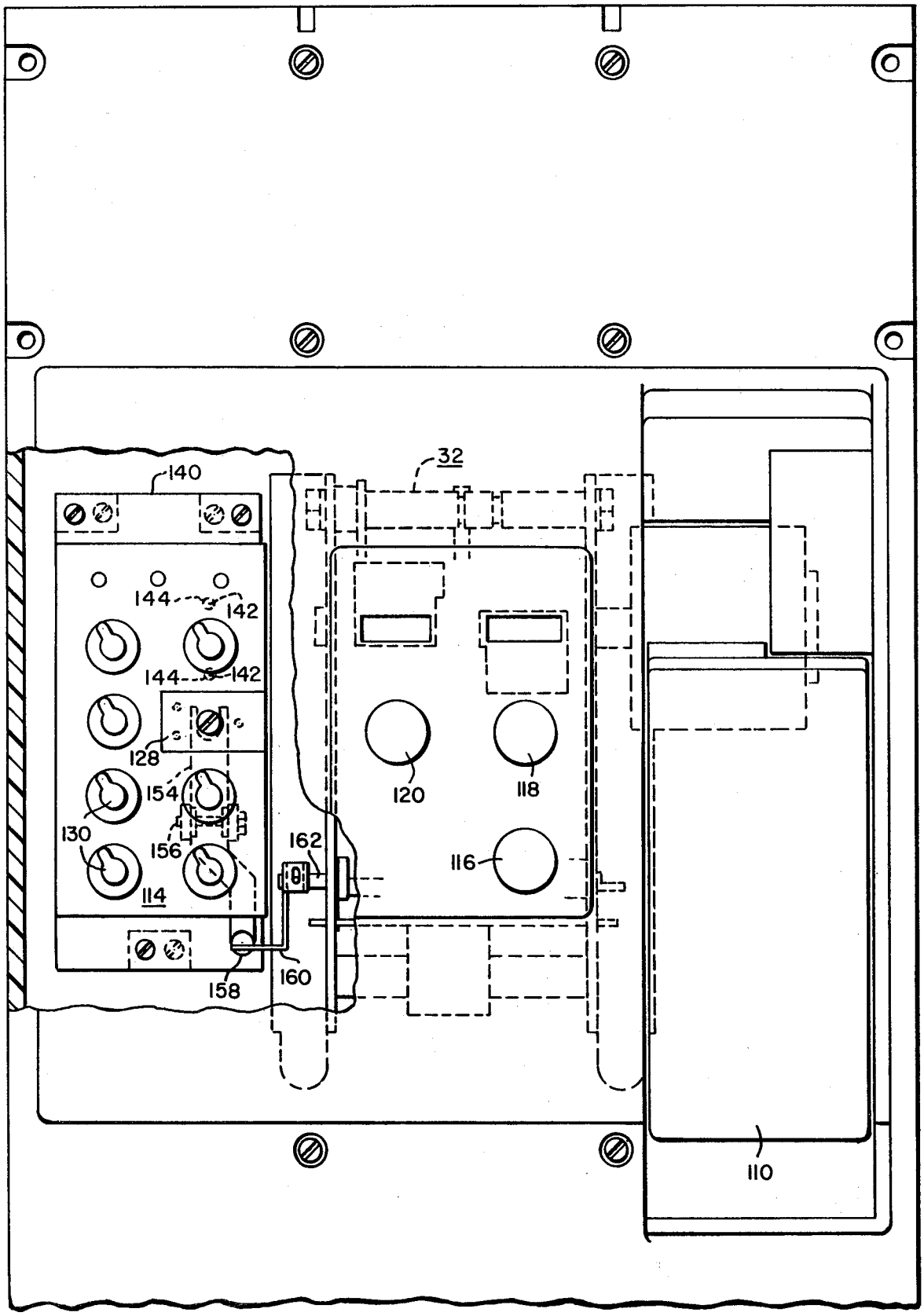
FIG. 5 is a view similar to FIG. 1 partially cut away to show details of the interlock mechanism.

Referring now to FIGS. 3A and 4, it can be seen that the trip unit 114 is seated in a recess 115 of the housing 12 and rests upon a steel mounting plate 140. Electronic circuitry within the trip unit 114 is electrically joined through a plug-in connector 139 to the sensing transformer 38 (FIG. 2) and the contact 22, supplying signal and power to the circuitry. The trip unit 114 is located in the housing recess 115 by rejection pins 142 mounted upon and extending upward from the plate 140. Corresponding holes 144 (FIG. 5) are drilled in the bottom of the trip unit housing. The pins and holes 142 and 144 are arranged in identical patterns such that the pins are received by the holes. Circuit interrupters having different electrical characteristics such as ground fault detection capability, higher interruption rating, etc., have rejection pins 142 arranged in different patterns. Similarly, different trip units 114 having electrical characteristics corresponding to these circuit interrupters have different patterns of holes 144. In each case, the pin pattern and hole pattern for compatible circuit interrupters and trip units is the same, such that only trip units having circuitry compatible with the particular circuit interrupter can be properly inserted in the housing 14. If a non-compatible trip unit is attempted to be inserted, the pins 142 and holes 144 will not line up and the trip unit cannot be seated in the housing. Thus, a common mold can be used for all circuit breaker housing and all trip unit housing while still maintaining a rejection capability to prevent mating of non-compatible trip units and circuit breakers.

As can be seen in FIG. 3A, a hexagonally shaped tapped tube 146 extends through a hex shaped hole in the mounting plate 140. The tapped tube 146 is free to move up and down but is prevented from rotating within the hole. A compression spring 152 is mounted around the tapped tube 146. The tapped tube 146 rides upon a lever 154 pivotally mounted at 156 to the mounting plate 140. The other end of the lever 154 is connected to a push rod 158 which in turn pushes a lever 160 attached to the trip arm mechanism 162 of the circuit breaker mechanism 32. As is described in the aforementioned copending U.S. Patent Application Ser. No. 811,227, clockwise rotation of the trip arm mechanism 162 is operable to release the toggle mechanism 34 causing the contacts 126, 128 to move to the open position.

With the rating adjuster 128 fully inserted into the recess into the housing of the trip unit 114, it can be seen that the screw 136 can be rotated to engage the threads of the tapped tube 146, thereby drawing the tube 146 upward against the biasing action of the spring 152. The lever 154 is then raised, removing bias force from the trip arm 162, allowing the circuit breaker to be normally operated to any desired open or closed position. If the rating plug 128 is not fully inserted into the housing of the trip unit 114 (as in FIG. 3B), or if an improper rating adjuster is inserted, the compression spring 152 will bias the lever 154 downward, causing the push rod 158 to be raised, thereby maintaining the trip arm mechanism 162 in a position of clockwise rotation. This position, as is described in the aforementioned U.S. Patent Application Ser. No. 811,227, maintains the circuit breaker in the trip-free condition, whereby it is not possible to cause the contacts 126, 128 to close. The position of the threads within the tapped tube 146 and the length of the crew 136 are coordinated such that only compatible rating plugs, trip units, and circuit breakers will allow the screw 136 to engage the tapped rod 146 in such a manner as to remove the breaker from the trip-free condition. The operation and construction of the rating adjuster interlock mechanism is described more completely in the aforementioned U.S. Patent Application Ser. No. 853,940.

Figure 6:
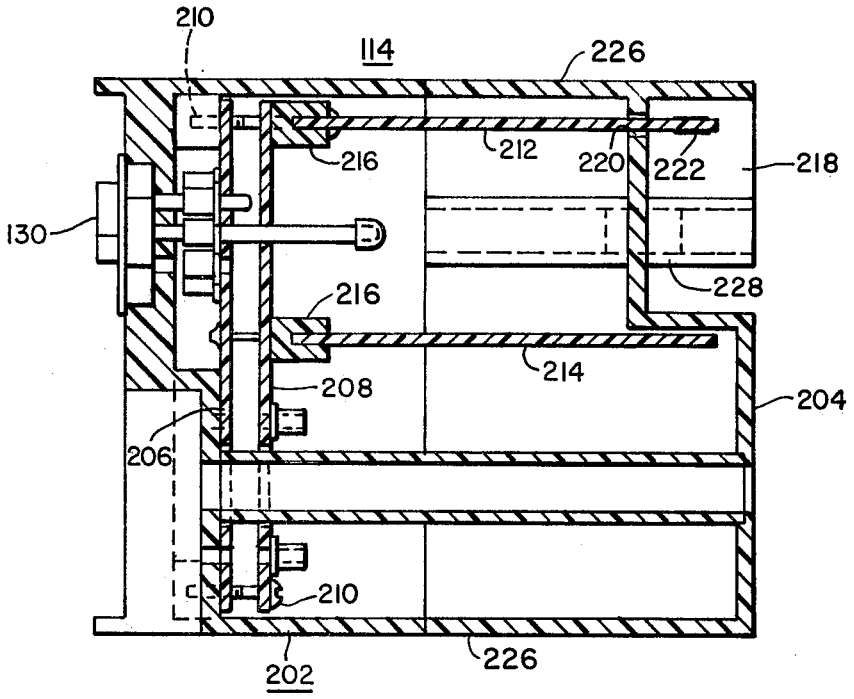
FIG. 6 is a sectional view of the removable trip unit taken along the line VI—VI of FIG. 3A.

As can be seen in FIG. 6, the trip unit 114 comprises an enclosure 202 and a rear cover 204. A switch board 206 and a first circuit board 208 are mounted parallel to the front panel of the enclosure member 202 by means of screws 210. Second and third circuit boards 212 and 214 are inserted edgewise into edge connectors 216 mounted upon the first circuit board 208. The components of the electronic circuit are also mounted upon the circuit boards 208, 212, 214. Plug-in circuit adjusting members 130 are inserted through the enclosure 202 for connection to sockets contained on the switchboard 206.

The trip unit rear cover member 204 includes a first recess 218 having a slot 220 through which extends the rear edge of the second circuit board 212. Terminals 222 of the electronic circuitry of the circuit board 212 are formed on this rear edge, and cooperate with the corresponding connecting member 139 attached to the mounting plate 140.

The top and bottom sides 226 of the enclosure 202 each include a recess 228 formed therein. The recess 228, shown most clearly in FIG. 3A, includes a sloping portion 230 and a step portion 232 to form a seating member. Secured to the mounting plate 140 are spring clip members 234 formed from spring steel. As can be seen, insertion of the trip unit 114 into the recess 115 of the circuit interrupter housing 112 causes the spring clip members 234 to initially contact the sloping portion 230. As the trip unit 114 is further inserted, the spring clip members 234 are stressed outwardly as they continue to ride upon the surface of the recess 228. As the trip unit is completely inserted into the recess, with the rear edge of the circuit board 212 being firmly seated in the connector 139, the spring clip members 234 snap over the edge of the step portion 232 of the recess 228, thereby securing the trip unit to the circuit interrupter. The spring clip members 234 are now inaccessible due to the circuit interrupter cover 13. Therefore the trip unit 114 cannot be removed without first removing the cover 13.

Figure 7:
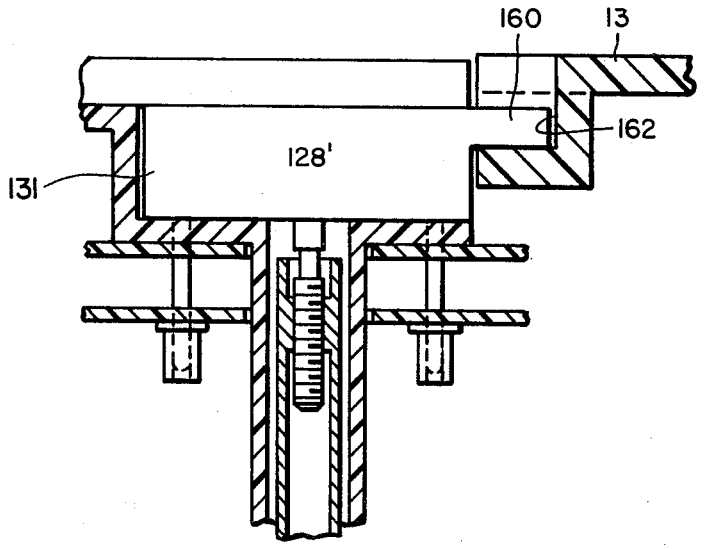
FIG. 7 is a view similar to FIG. 3A showing an embodiment employing an alternative rating adjuster.

As has been previously described, the trip unit 114 includes a removable interchangeable rating adjuster 128, which is inserted into a recess in the panel of the trip unit 114. The rating adjuster includes the screw 136 which cooperates with the tapped tube 146 to provide an interlock with the mechanisms 32 and 34. Unless a trip unit 114 is inserted into the recess 115, and a rating adjuster 128 is inserted into the corresponding recess, the interlock will maintain the mechanisms 32 and 34 in a trip-free condition, thereby preventing the circuit interrupter contacts 26, 28 from closing. In an alternative embodiment shown in FIG. 7, a rating adjuster 128' includes a member 160 extending over a portion of the circuit interrupter cover 13. With the trip unit 114 and rating adjuster 128' completely inserted in their proper positions, the extending member 160 and cooperating recesses and bosses of the enclosure 12 prevent the cover 13 from being removed. In order to remove the cover 13, the rating adjuster 128' must be removed, causing the breaker to trip. Thus the contacts are assured to be open whenever the cover 13 is off. It can therefore be seen that with the trip unit 114, the rating adjuster 128 or 128', and the cover 13 all in position, the spring clip members 234 are completely inaccessible. In order to release the spring clip members 234 and withdraw the trip unit, it is necessary to first remove the cover. This, in turn, requires removal of the rating adjuster 128'. As has been described however, removal of the rating adjuster 128 or 128' allows the interlock linkage to place the mechanisms 32 and 34 in a trip-free condition and open the circuit interrupter contacts. These contacts thus will always be open whenever a trip unit is not present in the circuit interrupter. This insures that the circuit connected to the interrupter will not be energized unless and until a trip unit is properly installed and that the protective capabilities of the circuit interrupter are operational.

It can be seen therefore that the present invention provides a circuit interrupter having a removable trip unit which is interlocked with the current breaker mechanisms to provide safety features heretofore unavailable in the prior art.

We claim:

1. A circuit interrupter, comprising:

a housing comprising a removable cover, a circuit breaker mechanism disposed in said housing, and comprising separable contacts operable between open and closed positions and a trip mechanism releasble to effect automatic opening of said contacts;

means for sensing current flow through said contacts;

a removable trip unit disposed in said housing and connected to said sensing means and said trip mechanism, said trip limit causing release of said trip mechanism upon overcurrent conditions through said contacts; and mounting means for securing said trip unit to said housing, said mounting means permitting said trip unit to be inserted into said housing with said cover in place but disposed within said housing so as to be inaccessible without removal of said cover, thereby preventing removal of said trip unit without first removing said cover.

2. A circuit interrupter as recited in claim 1 wherein said mounting means comprises a spring clip member and a seating member, said seating member comprising a sloping portion and a step portion, insertion of said trip unit into said housing causing said clip member to ride along said sloping portion such that said spring clip member is increasing loaded, complete insertion of said trip unit into said housing causing said clip member to seat in said step portion such that removal of said trip unit is not possible without release of said clip member.

3. A circuit interrupter as recited in claim 2 comprising interlock means disposed in said housing and cooperating with said cover and said trip mechanism to release said trip mechanism upon removal of said cover, thereby opening said contacts.

4. A circuit interrupter as recited in claim 3 comprising a removable rating adjuster cooperating with said trip unit to establish the trip current level of said circuit interrupter and comprising a member extending over a portion of said cover to prevent removal of said cover without first removing said rating adjuster, said rating adjuster being removably connected to said interlock means and causing said interlock means to release said trip mechanism and open said contacts upon removal of said rating adjuster.

5. A circuit interrupter as recited in claim 4 comprising a mounting plate disposed within said housing and recessed from said cover, and wherein said interlock means comprises a tapped tube and said rating adjuster comprises a mounting screw threaded into said tube when said rating adjuster is fully inserted, said mounting plate supporting said tapped tube and said spring clip member.

6. A circuit interrupter as recited in claim 1 wherein said unitary trip device comprises electronic circuit means for analyzing the output of said sensing means and for generating command signals to cause said trip mechanism to release.

7. A circuit interrupter, comprising:

a housing comprising a recessed portion;

a circuit breaker mechanism disposed in said housing, and comprising separable contacts and a trip mechanism releasable to effect automatic opening of said contacts;

means for sensing current flow through said contacts;

a unitary interchangeable trip device disposed in said recessed portion, and connected to said sensing means and said trip mechanism, said trip device causing release of said trip mechanism upon detection of overload current through said contacts; and one-way means for securing said trip device to said housing, said securing means permitting insertion of said trip device into said recessed portion but preventing removal of said trip device unless and unlatching operation is performed.

8. A circuit interrupter as recited in claim 7, wherein said unitary trip unit device comprises electronic circuitry for analyzing the output of said sensing means and generating command signals to said trip mechanism.

* * * * *